US005869429A

United States Patent [19]

Das

[11] Patent Number: 5,869,429

[45] Date of Patent: Feb. 9, 1999

[54] HIGH TC SUPERCONDUCTING FERROELECTRIC CPW TUNABLE FILTERS

[76] Inventor: Satyendranath Das, P.O. Box 574, Mt. View, Calif. 94042-0574

[21] Appl. No.: 848,715

[22] Filed: May 19, 1997

[51] Int. Cl.[6] ..... H01P 1/203; H01B 12/02

[52] U.S. Cl. ..... 505/210; 505/210; 505/700; 505/701; 505/866; 333/205; 333/99 S

[58] Field of Search ..... 333/99 S, 204, 333/205, 219; 505/210, 700, 701, 866

[56] References Cited

U.S. PATENT DOCUMENTS 2,945,195 7/1960 Matthaei ..... 333/204
5,472,935 12/1995 Yandrofski et al. ..... 505/210

FOREIGN PATENT DOCUMENTS 6152201 5/1994 Japan ..... 333/204

*Primary Examiner*—Benny T. Lee

[57] ABSTRACT

A main symmetrical CPW structure is formed by depositing three parallel films of a conductor on a film of a single crystal ferroelectric material. Cavities are formed by placing irises in a main CPW structure. These cavities are tuned to a dominant resonant frequency. By the application of a bias voltage to the main CPW structure with cavities, the permittivity of the film of the ferroelectric material, underneath the CPW structure, is changed. Thus the dominant resonant frequency of the filter is changed. By changing the level of the bias voltages, different dominant resonant frequencies of the filter are obtained. Thus a tunable band pass filter is obtained. With branch cavities on a CPW structure deposited on a ferroelectric film, a tunable band reject filter is obtained.

20 Claims, 14 Drawing Sheets

OUTPUT
11
INPUT
10
MICROPROCESSOR
35
TO V
COMMAND

FIG.5
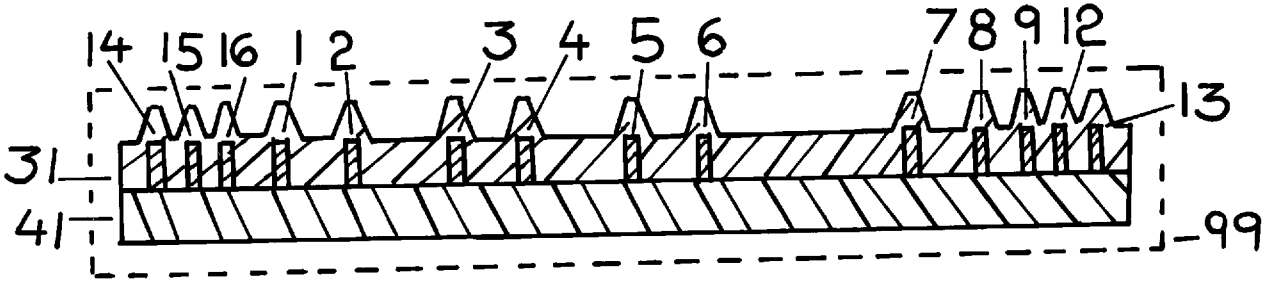
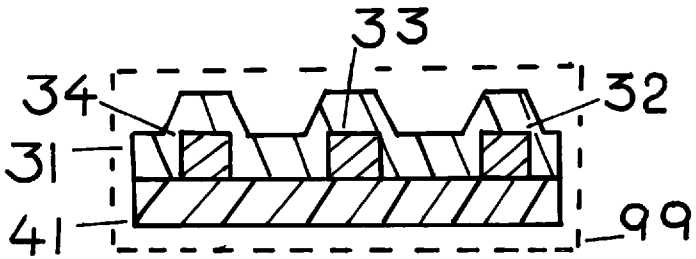
FIG.6

HIGH TC SUPERCONDUCTING FERROELECTRIC CPW TUNABLE FILTERS

FIELD OF INVENTION

The present invention relates to filters for electromagnetic waves and more particularly, to RF filters which can be controlled electronically. Commercial YIG filters are available.

DESCRIPTION OF THE PRIOR ART

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large, and as such the device is small in size. The ferroelectrics are operated in the paraelectric phase, i.e. slightly above the Curie temperature to prevent hysteresis and a hysteresis loss with a.c. biasing field. Inherently, they have a broad bandwidth. They have no low frequency limitation as contrasted to ferrite devices. The high frequency operation is governed by the relaxation frequency, such as 95 GHz for strontium titanate, of the ferroelectric material. The loss of the ferroelectric high Tc superconductor RF tunable filters is low for ferroelectric materials, particularly single crystals, with a low loss tangent. A number of ferroelectrics are not subject to burnout. Ferroelectric tunable filters are reciprocal. Because of the dielectric constant of these devices vary with a bias voltage, the impedance of these devices vary with a biasing electric field.

There are three deficiencies to the current technology: (1) The insertion loss is high as shown by Das, U.S. Pat. No. 5,451,567. (2) The properties of ferroelectrics are temperature dependent. (3) The third deficiency is the variation of the VSWR over the operating range of the time delay device.

Das used a composition of polycrystalline barium titanate, of stated Curie temperature being 20 degrees C. and of polythene powder in a cavity and observed a shift in the resonant frequency of the cavity with an applied bias voltage as discussed in the publication by S. Das, "Quality of a Ferroelectric Material," IEEE Trans. MTT-12, pp. 440–448, July 1964.

Das discussed operation, of microwave ferroelectric devices, slightly above the Curie temperature, to avoid hysterisis and showed the permittivity of a ferroelectric material to be maximum at the Curie temperature and the permittivity to reduce in magnitude as one moves away from the Curie temperature as discussed in the publication by S. Das, "Quality of a Ferroelectric Material," IEEE Trans. MTT-12, pp. 440–445, July 1964.

Properties of ferroelectric devices have been discussed in the literature. R. Das, "Ferroelectric Phase Shifters," IEEE Int'l Sympopsium Digest, pp. 185–187, 1987. In 1967, this inventor stated a dielectric loss of 0.035 dB per wavelength in a typical single crystal ferroelectric material in R. Das, "Thin Ferroelectric Phase Shifters'" Solid State Electronics, vol. 10, pp. 857–863, 1967. Ferroelectrics have been used for the time delay steering of an array. S. Das, "Ferroelectrics for time delay steering of an array," Ferroelectrics, 1973, pp. 253–257. Scanning ferroelectric apertures have been discussed. S. Das, "Scanning ferroelectric apertures," The Radio and Electronic Engineer, vol. 44, No. 5, pp. 263–268, May 1974. A high Tc superconducting ferroelectric phase shifter has been discussed. C. M. Jackson, et al, "Novel monolithic phase shifter combining ferroelectric and high temperature superconductors," Microwave and Optical Technology Letters, vol. 5, No. 14, pp. 722–726, Dec. 20, 1992. One U.S. Pat. No. 5,472,936 has been issued.

SUMMARY OF THE INVENTION

A main symmetrical CPW structure is formed by depositing three parallel films of a conductor on a film of a single crystal ferroelectric material. Cavities are formed by placing irises in a main CPW structure. These cavities are tuned to a dominant resonant frequency. By the application of a bias voltage to the main CPW structure with cavities, the permittivity of the film of the ferroelectric material, underneath the CPW structure, is changed. Thus the dominant resonant frequency of the filter is changed. By changing the level of the bias voltages, different dominant resonant frequencies of the filter are obtained. Thus a tunable band pass filter is obtained. With branch cavities on a CPW structure deposited on a ferroelectric film, a tunable band reject filter is obtained.

One objective of this invention is to obtain a dielectric loss typically of 0.035 dB per wavelength in a single crystal ferroelectric material. Examples are $Sr_{1-x}Ba_xTiO3$, $Sr_{1-x}Pb_xTiO_3$, $KTa_{1-x}Nb_xO_3$. Other ferroelectric materials are potassium dihydrogen phosphate (KDP) and triglycine sulphate (TGS). Another objective is to obtain a 50 ohm main CPW structure and thus to obtain a good match to an input and an output circuit. Another object is to obtain the lowest conductive loss by using a single crystal high Tc superconducting material. Examples are YBCO and TBCCO. Another objective is to avoid hysteresis by working typically above the Curie temperature of the ferroelectric material and thus (1) to avoid two values of permittivity of a ferroelectric material for each level of a bias electric field and (2) to avoid hysteresis loss with a.c. biasing. Another object of this design is to design tunable filters to handle power levels of at least 0.5 Megawatt. With these and other objectives in view, as well hereinafter be more particularly pointed out in detail in the appended claims, reference is now made to the following description taken in connection with accompanying diagrams.

BRIEF DESCRIPTION OF THE DRAWINGS

FIG. 5 depicts a longitudinal cross-section of FIG. 4 through section line I—I.

FIG. 6 depicts a transverse cross-section of FIG. 4 through section line II—II.

DETAILED DESCRIPTION OF THE PREFERRED EMBODIMENTS

Figure 1:
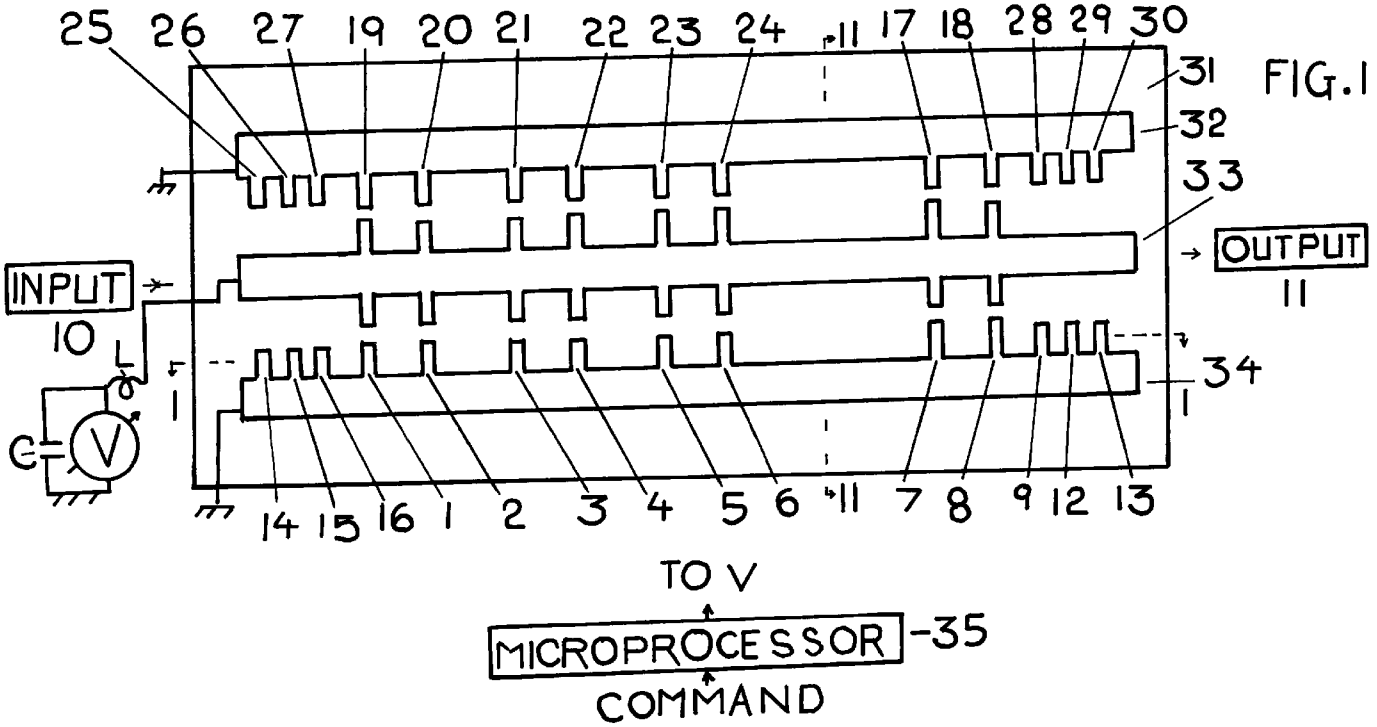
FIG. 1 depicts a top view of a CPW ferroelectric tunable band pass filter.

The same number/label refers to the same element throughout this document. The filters of this invention are suitable for cellular, mobile, personal communications, satellite, Irridium, Teledesic, Odessey, Globalstar, Intelsat, Inmarsat, Astra, Skynet, domestic satellite, broadcasting satellite, navigation satellite, terrestrial microwave, shipbourne, aircraft, spacebourne systems. In FIG. 1 is depicted one embodiment of this invention, a top view of a symmetrical coplanar waveguide (CPW) cavity tunable filter. FIG. 1 is a tunable band pass filter. A second layer is a film 31 of a single crystal ferroelectric material deposited on a single crystal dielectric material not shown in this diagram. Examples of ferroelectric materials are: $Sr_{1-x}Ba_xTiO_3$, $Sr_{1-x}Pb_xTiO_3$, $KTa_{1-x}Nb_xO_3$, where the value of x varies between 0.005 and 0.7, potassium dihydrogen phosphate (KDP), triglycine sulphate (TGS). These examples are used in all embodiments herein. A single crystal ferroelectric, as opposed to polycrystalline material, is used to obtain a dielectric loss of 0.035 dB/ wavelength in the ferroelectric material at 77 degrees K. A third layer is film depositions, of a conductive material, of the symmetrical CPW structure of the tunable band pass filter. The main symmetrical coplanar waveguide is formed by three parallel lines. The central one is designated as a first line. On one side of the first line is a second line. On the other side of the first line is a third line. The filter structure is symmetrical with respect to the first line which is a film 33 of a conductive deposition. The second line is a film 32 of a conductive deposition. The third line is a film 34 of a conductive deposition. Between the first and the second lines are inserted pairs of irises 19 and 20, 21 and 22, 23 and 24, and 17 and 18. Between the first line and the third line are inserted pairs of irises 1 and 2, 3 and 4, 5 and 6 and 7 and 8. Separation distance between each pair of irises is a quarter of a wavelength, at an operating frequency of the tunable filter, foreshortened by the presence of the irises. The CPW bounded by each pair of irises acts like a cavity and resonates to its dominant frequency. The central line is connected to a variable bias source V through an RF filter formed by an inductance L and a capacitance C. The second line and the third line are both connected to an electrical ground. On the application of a bias voltage V to the first line, the permittivity of the ferroelectric material between the first line and the second line, and between the first line and the third line changes, thus changing the resonant frequency of the cavity. Application of different levels of bias voltages V produces different resonant frequencies. Thus a tunable band pass filter is obtained. Four cavities are shown in FIG. 1. There are, in practice, 1, 2 . . . n cavities in a tunable band pass filter depending on the specific requirements. In one embodiment, all cavities are designed to be tuned to the same dominant resonant frequency to produce a higher attenuation, outside the pass band, than that can be obtained with a single cavity. In another embodiment, each cavity is designed to resonate at a staggered frequency from that of an adjacent one thus producing a broad band tunable band pass filter. The tuning frequency of the band pass filter is calibrated as a function of the level of the bias voltage V. This information is stored in a microprocessor 35 having a memory. On receipt of a command for a specific frequency, an appropriate level of bias voltage V is applied to the filter at the control of the microprocessor 35. The separation distance between the adjacent cavities is approximately three quarters of a wavelength at an operating frequency of the filter. The separation distance is dependent on many factors. Some of them are the response of the filter as a function of frequency, frequency, bandwidth, number of cavities used, the permittivity of the ferroelectric material. This separation distance is different between the different cavities and has to be calculated in each individual case. The basic CPW is designed to have 50 ohm impedance. Because of the introduction of the irises, the impedance of the CPW changes and is dependent on the number of irises used, the frequency of operation, the bandwidth of the filter. To match the input impedance of the filter to an impedance of the input circuit, stubs 25, 26, 27 and stubs 14, 15, 16 are provided. The number of stubs required, for a good match, has to be determined in each individual case. For matching the output impedance of filter to an impedance of the output circuit, stubs 28, 29, 30 and stubs 9, 12, 13 are provided. The number of stubs, required for a good match, will be designed in each individual case. The filter is operated at a constant temperature slightly above the Curie temperature of the ferroelectric material. In one embodiment, conductive materials like copper, silver, gold are used and they operate, amongst others, at the room temperature. They are designated herein as room temperature conductive materials. In another embodiment, a single crystal high Tc superconductor is used. Examples are YBCO, TBCCO. A single crystal, as opposed to polycrystalline form of a high Tc superconductor material, is used to reduce the conductive losses to a minimum value.

Figure 2:
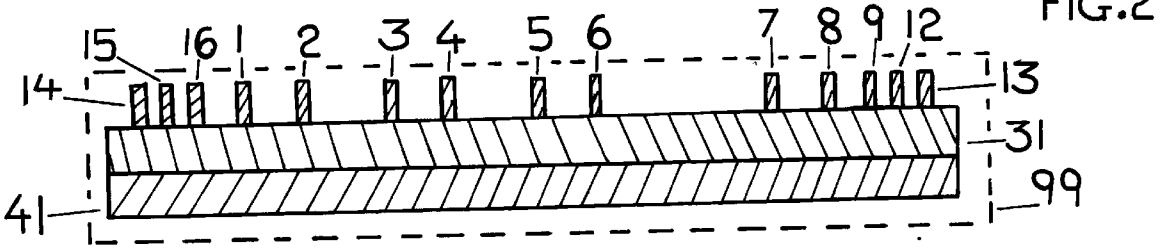
FIG. 2 depicts a longitudinal cross-section of FIG. 1 through section line I—I.
Figure 3:
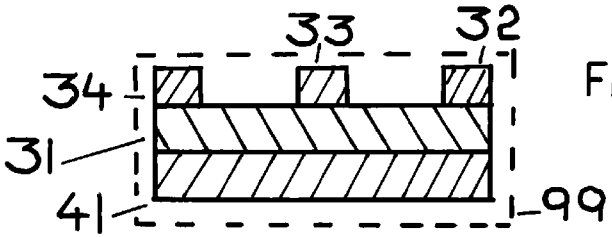
FIG. 3 depicts a transverse cross-section of FIG. 1 through section line II—II.

Same number/label is used to refer to the same element throughout this document. Input is 10 and output is 11. FIG. 2 is a longitudinal cross-section through section line I—I of FIG. 1. A first layer is a single crystal dielectric material substrate 41. A single crystal, as opposed to a polycrystalline form, is used to reduce the dielectric loss to a minimum value. A second layer is a film 31 of a single crystal ferroelectric material deposited on the single crystal dielectric material 41 of the first layer. A single crystal, as opposed to a polycrystalline form of the ferroelectric material, is used to obtain a dielectric loss of 0.035 dB per wavelength in the ferroelectric material. A third layer is the circuit of the tunable filter. In FIG. 2, the third layer contains the matching stubs 14, 15, 16, pairs of irises 3 and 4, 5 and 6, and 7 and 8, and matching stubs 9, 12, 13. The elements of the third layer are films of a conductive material and are deposited on the film 31 of a single crystal ferroelectric material of the second layer. In one embodiment, the conductive material is one of the following: copper, silver, gold which operate, amongst others, at the room temperature. In this document these conducting materials are designated as room temperature conducting materials. In another embodiment, the conducting material is a high Tc superconductor. Examples are YBCO, TBCCO. The element 99 is a device for operation at a constant temperature. In one embodiment, element 99 permits operation at a constant room temperature. In another embodiment, element 99 is a cryocooler and permits operation at a constant high superconducting temperature. Same number/label refers to the same element throughout this document. FIG. 3 is a transverse cross-section, through section line II—II, of FIG. 1. The elements have been recited earlier herein.

Figure 4:
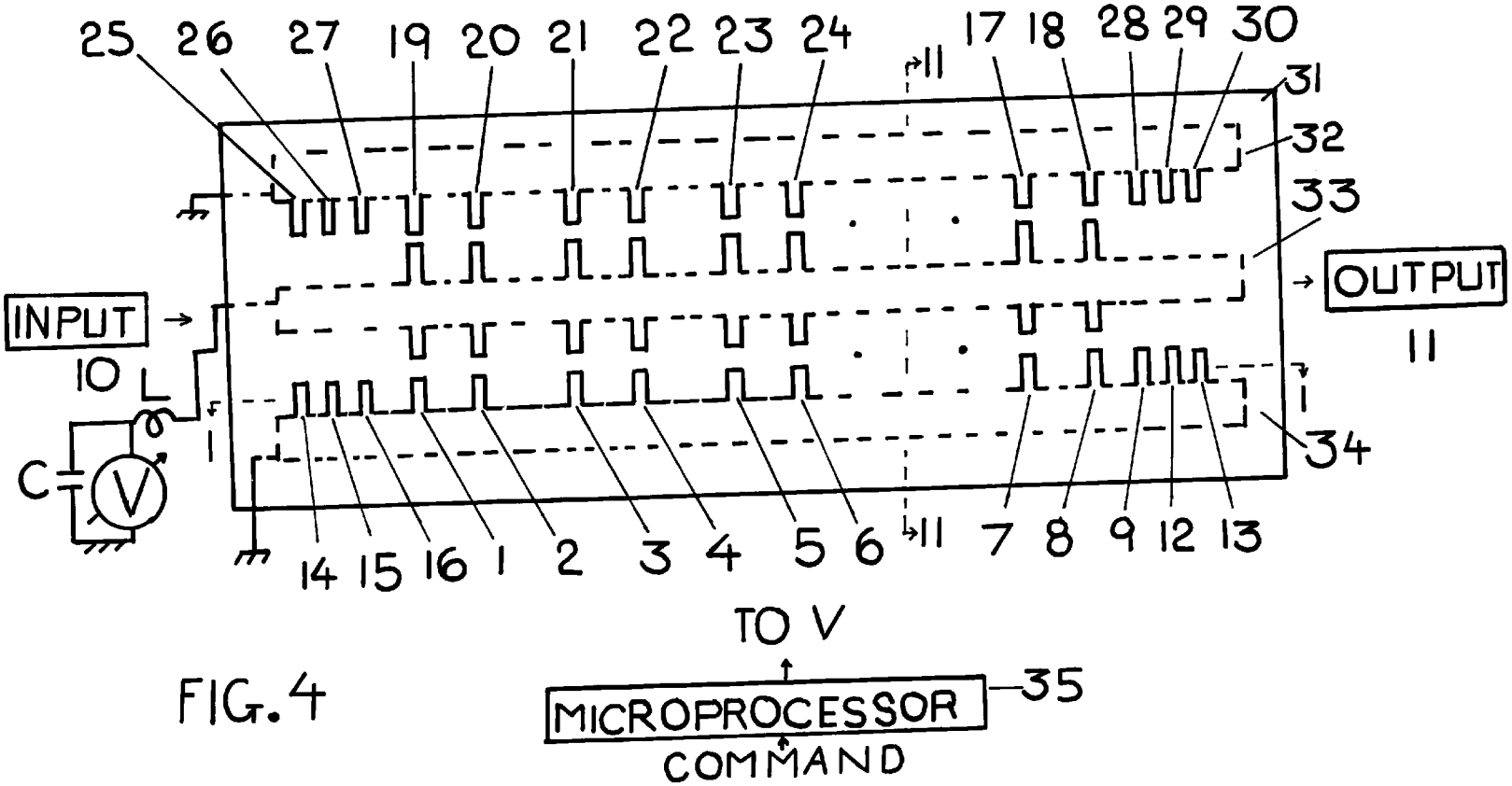
FIG. 4 depicts a top view of a CPW ferroelectric tunable band pass filter.

FIG. 4 is another embodiment of this invention, a symmetrical CPW tunable band pass filter. A second layer of the filter circuit, films of a conducting material, is deposited on a first layer a film 41 of a single crystal dielectric material. A third layer is a film 31 of a single crystal ferroelectric material and is deposited on the single crystal dielectric material 41 as well as on the films of a conducting material of the second layer forming the circuit of the filter. The elements, referred to by the numbers, have been recited earlier herein. The discussions of FIG. 1 are repeated here by reference. Input is 10 and output is 11.

FIG. 5 is a longitudinal cross-section, through section line I—I, of FIG. 4. The elements, referred to by the numbers, have been recited earlier herein.

FIG. 6 is a transverse cross-section, through section line II—II, of FIG. 4. The elements, referred to by the numbers, have been recited earlier herein. FIG. 5 and FIG. 6 have some special features discussed below. First, the third layer ferroelectric film 31 provides protection to the conductive films of second layer. Second, the third layer ferroelectric film 31 provides a larger volume of ferroelectric material over which a bias electric field is applied. Third, the third layer ferroelectric film 31 is epitaxially deposited on the single crystal dielectric material 41. Of course, the high Tc superconductor of second layer is be epitaxially deposited on the single crystal dielectric substrate 41 of the first layer.

Same number/label refers to the same element throughout this document.

Figure 7:
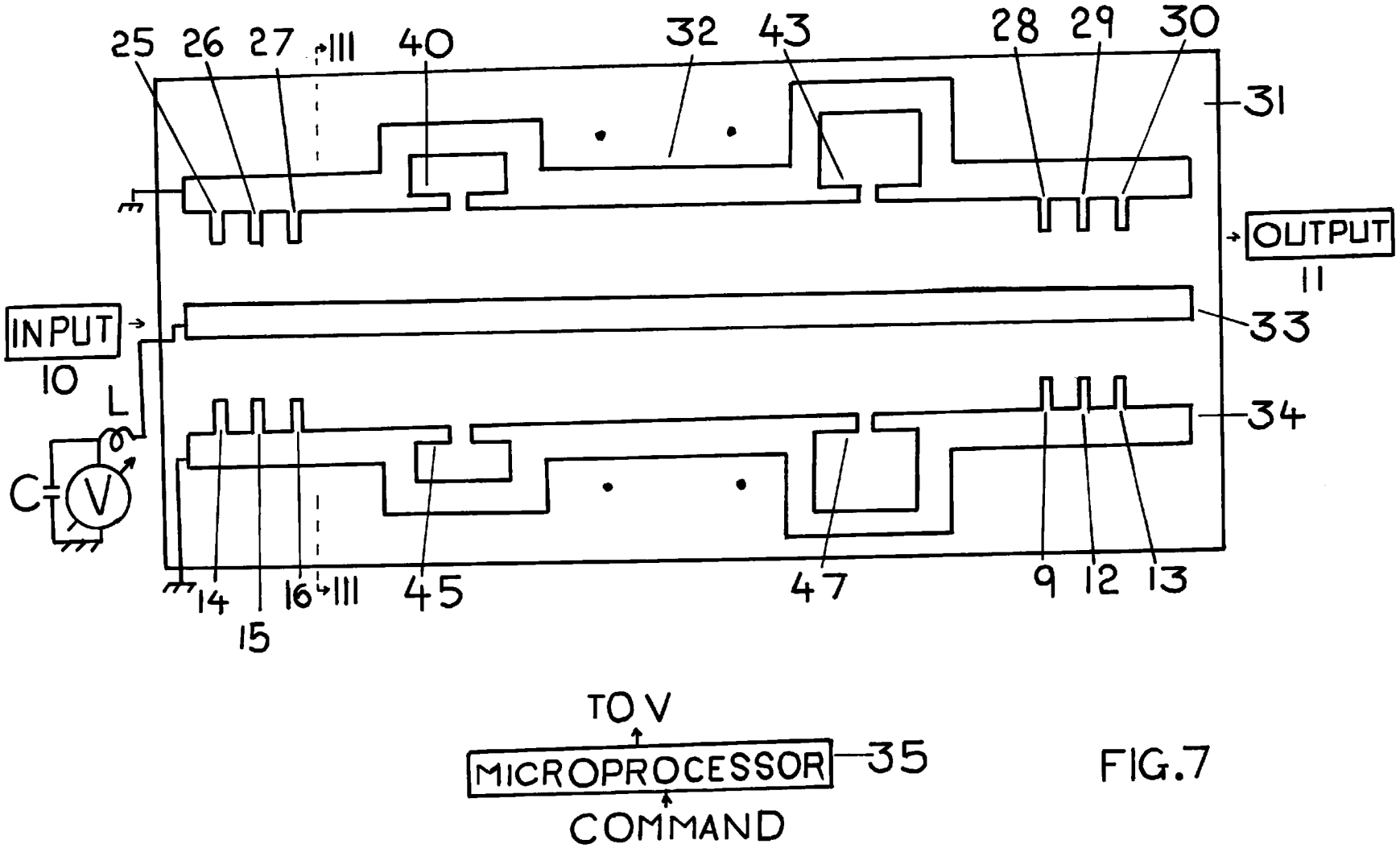
FIG. 7 depicts a top view of a CPW ferroelectric tunable band reject filter.

FIG. 7 is another embodiment of this invention, a top view of a tunable symmetrical CPW band reject filter. In the main CPW second line 32 is introduced a first branch CPW cavity with an iris 40. The first branch cavity is one quarter wavelength long, at an operating frequency of the tunable filter, foreshortened by the iris 40. In the main CPW third line 34 is introduced a second branch cavity with an iris 45. The second branch cavity is one quarter wavelength long, at an operating frequency of the tunable filter, foreshortened by the iris 45. At a dominant resonant frequency of the cavity, the first and second branch cavities absorb energy from the main CPW. As one moves away from the dominant resonant frequency, first and second branch cavities absorb a smaller amount of energy, from the main CPW, compared to that absorbed at the resonant frequency. When the operating frequency is far off from the dominant resonant frequency, first and second branch cavities do not absorb any energy from the main CPW. Thus a band reject filter is obtained. When a bias voltage V is applied to the filter, the permittivity of the ferroelectric material between the CPW first line and second line and between CPW first line and third line change, thus changing the resonant frequency of the first and second branch cavities. Upon the application of different levels of bias voltages different dominant frequencies, for the first and second branch cavities, are obtained. Thus a tunable band reject filter is obtained. Input is 10 and output is 11.

A third branch cavity, with an iris 43, is inserted on the CPW second line. A fourth branch cavity, with an iris 47, is inserted on the third line. During a dominant resonant frequency, the third branch cavity and the fourth branch cavity absorb energy from the main CPW. Far away from the dominant resonant frequency, third and fourth branch cavities do not absorb any energy from the main cavity. Only two symmetrical cavities are shown in FIG. 7. In practice 1, 2 . . . n cavities are used in a tunable band reject filter depending on the requirements. When the dominant resonant frequencies of cavities 1, 2 . . . n are the same, the attenuation inside the band is higher than that can be obtained by one cavity alone. When 1, 2 . . . n cavities are tuned to a dominant resonant frequency staggered from an adjacent one, then a broad bandwidth band reject filter is obtained. When cavities 1, 2 . . . n are tuned to separate dominant resonant frequencies, then rejection is obtained respectively at different frequencies. Same number/label refers to the same element throughout this document. The rest of the discussions of FIG. 1 is repeated here by reference. FIG. 3 also depicts a transverse, through section line III—III, cross-section of FIG. 7.

FIG. 3 has been recited earlier.

Figure 8:
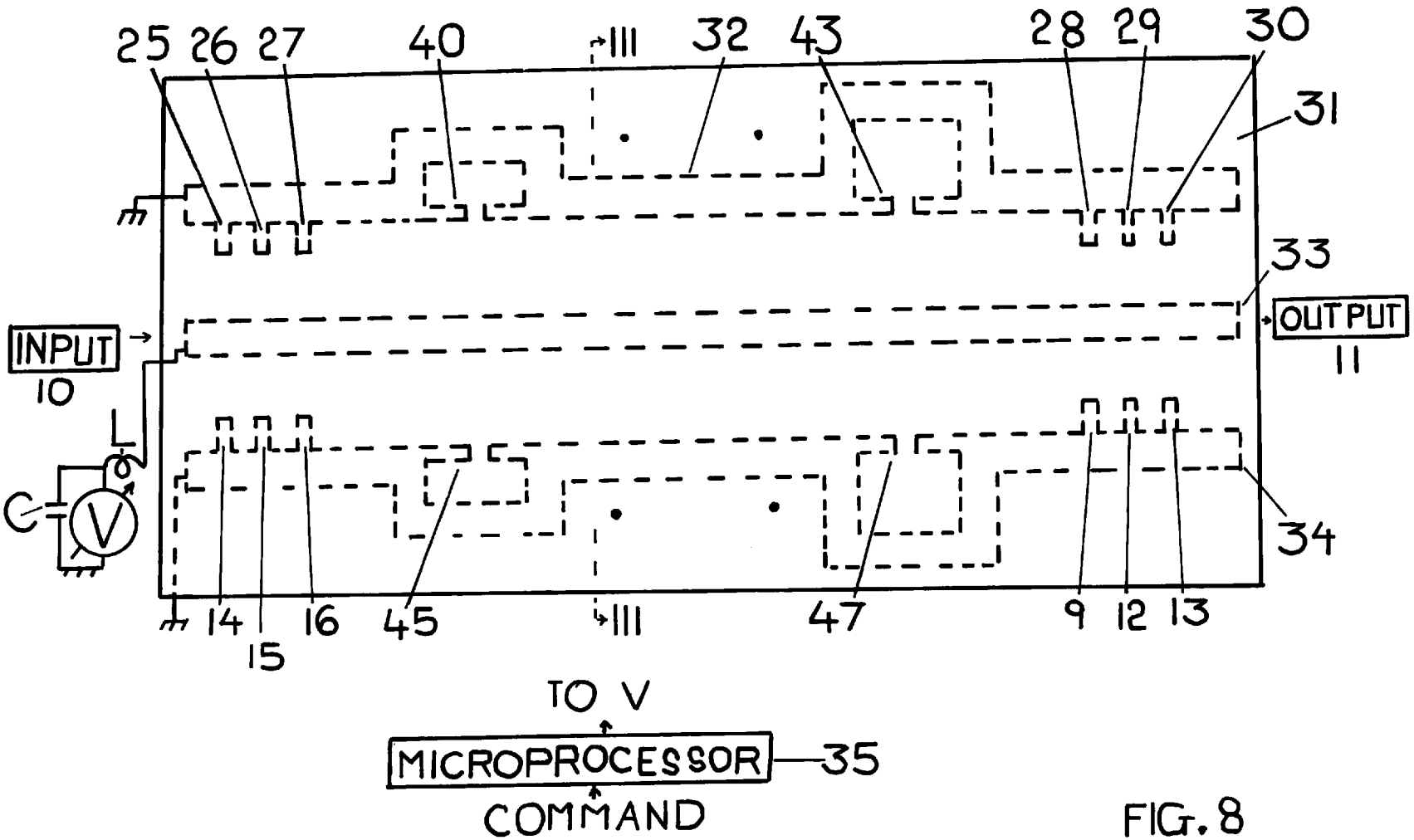
FIG. 8 depicts a top view of a CPW ferroelectric tunable band reject filter.

FIG. 8 is another embodiment of this invention, a top view of a symmetrical CPW tunable band reject filter. The basic difference between FIG. 8 and FIG. 7 is in the second layer and the third layer. In FIG. 8, the second layer is the conductive film depositions of the tunable filter on top of a single crystal dielectric substrate 41. The third layer is a film 31 of a single crystal ferroelectric material deposited on the second layer, conductive depositions of the filter, and a first layer a single crystal dielectric substrate 41. Same number/label refers to the same element throughout this document. The rest of the discussions of FIG. 7 is repeated here by reference.

Figure 9:
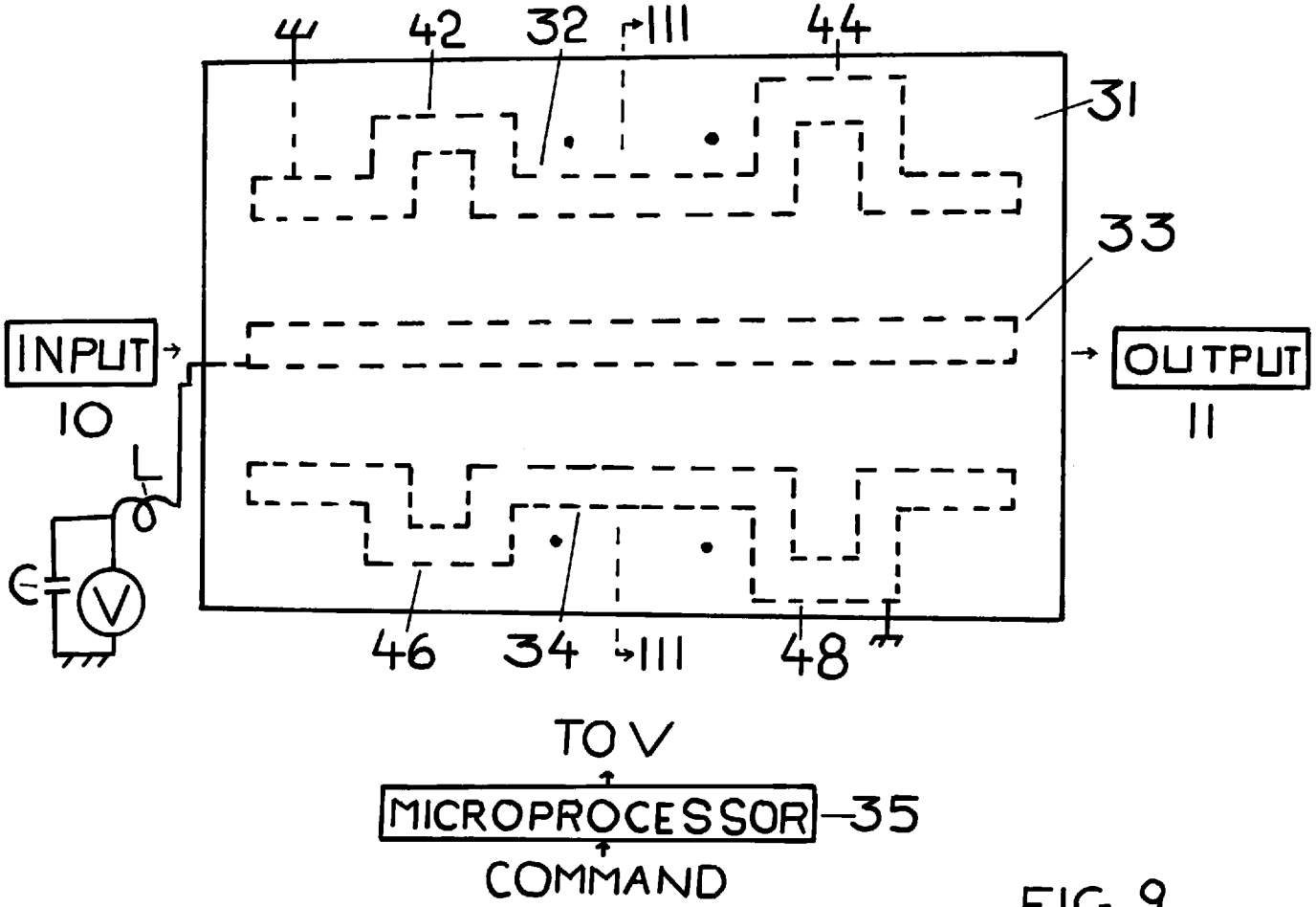
FIG. 9 depicts a top view of another CPW ferroelectric tunable band pass filter.

FIG. 6 also depicts a transverse cross-section of FIG. 8 through section line III—III. FIG. 9 is another embodiment of this invention, a top view of a tunable symmetrical CPW band pass filter. A third layer is a film 31 of a single crystal ferroelectric material. A second layer, shown dotted, is the circuit of the tunable filter. In CPW second line, represented by 32, a branch half a wavelength, at an operating frequency of the filter, long, shorted at the other end, 42 is introduced. In CPW third line, represented by 34, a branch half a wavelength, at an operating frequency of the filter, long, shorted at the other end, 46 is introduced. At a frequency at which branch CPW lines 42 and 46 are half a wavelength long, at an operating frequency of the filter, a short circuit is presented at the main CPW lines 32 and 34 respectively. The input signal travels unimpeded towards the output. At a frequency at which the branch CPW lines 42 and 46 depart from a half a wavelength long, an impedance is introduced at the main CPW lines 32 and 34 respectively, impeding the travel of the input signal to the output thus introducing an attenuation. At a frequency at which branch CPW lines 42 and 46 depart further from a half a wavelength long, a higher impedance is introduced at the main CPW lines 32 and 34 respectively, greatly impeding the travel of the input signal to the output and thus introducing a higher level of attenuation. Thus a band pass filter is obtained. Upon the application of a bias voltage V, the permittivity of the single crystal ferroelectric material between the main CPW and branch CPW lines change, resulting in a change in the electrical length of the branch CPW lines 42 and 46. Upon the application of different levels of bias voltages V between the main and the branch CPW lines, different permittivities of the single crystal ferroelectric material are obtained resulting in different electrical lengths for the branch CPW lines 42 and 46. Thus a tunable band pass filter is obtained. In the second line, represented by 32, a second branch CPW line 44, half a wavelength long, at an operating frequency of the filter, long and shorted at the other end is introduced. In the third line, represented by 34, a second branch CPW line 48, half a wavelength long, at an operating frequency of the filter, long and shorted at the other end is introduced. The branch CPW lines 44 and 48 perform in a similar manner as the branch CPW lines 42 and 46. Only two branch lines, on each main CPW lines, represented by 32 and 34, are shown in FIG. 9. In practice, there are 1, 2 . . . . n branch lines, on each main CPW second and third lines represented by 32 and 34, in a filter depending on the requirements. When the length of each branch line is half a wavelength long at the same operating frequency, then a higher attenuation, than that is obtained with a single branch line, is obtained outside the pass band. When the length of each branch line is half a wavelength, at a frequency staggered from its adjacent one, then a broader bandwidth tunable filter is obtained. The rest of the applicable discussions of FIG. 1 are introduced here by reference. Input is 10 and output is 11.

FIG. 6 also depicts a transverse cross-section of FIG. 9 through section line III—III.

Figure 10:
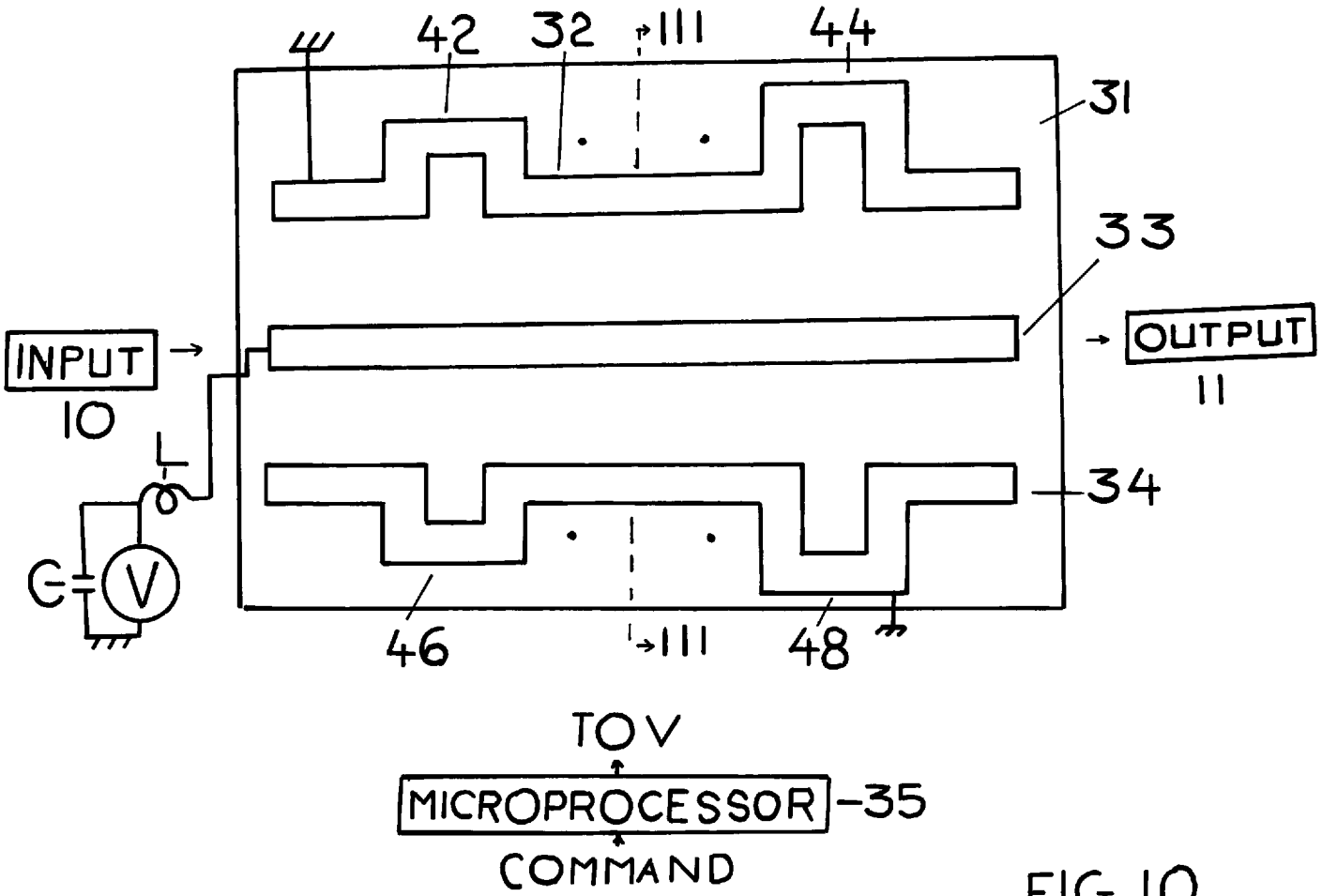
FIG. 10 depicts a top view of another CPW ferroelectric tunable band pass filter.

FIG. 10 is another embodiment of this invention, a top view of a symmetrical CPW tunable band pass filter. The difference between the FIG. 9 and FIG. 10 is in the second and third layers. In FIG. 10, the third layer is the circuit of the tunable filter. The second layer is a film of a single crystal ferroelectric material. By reference, the rest of the applicable discussion of FIG. 9 is introduced here.

Figure 11:
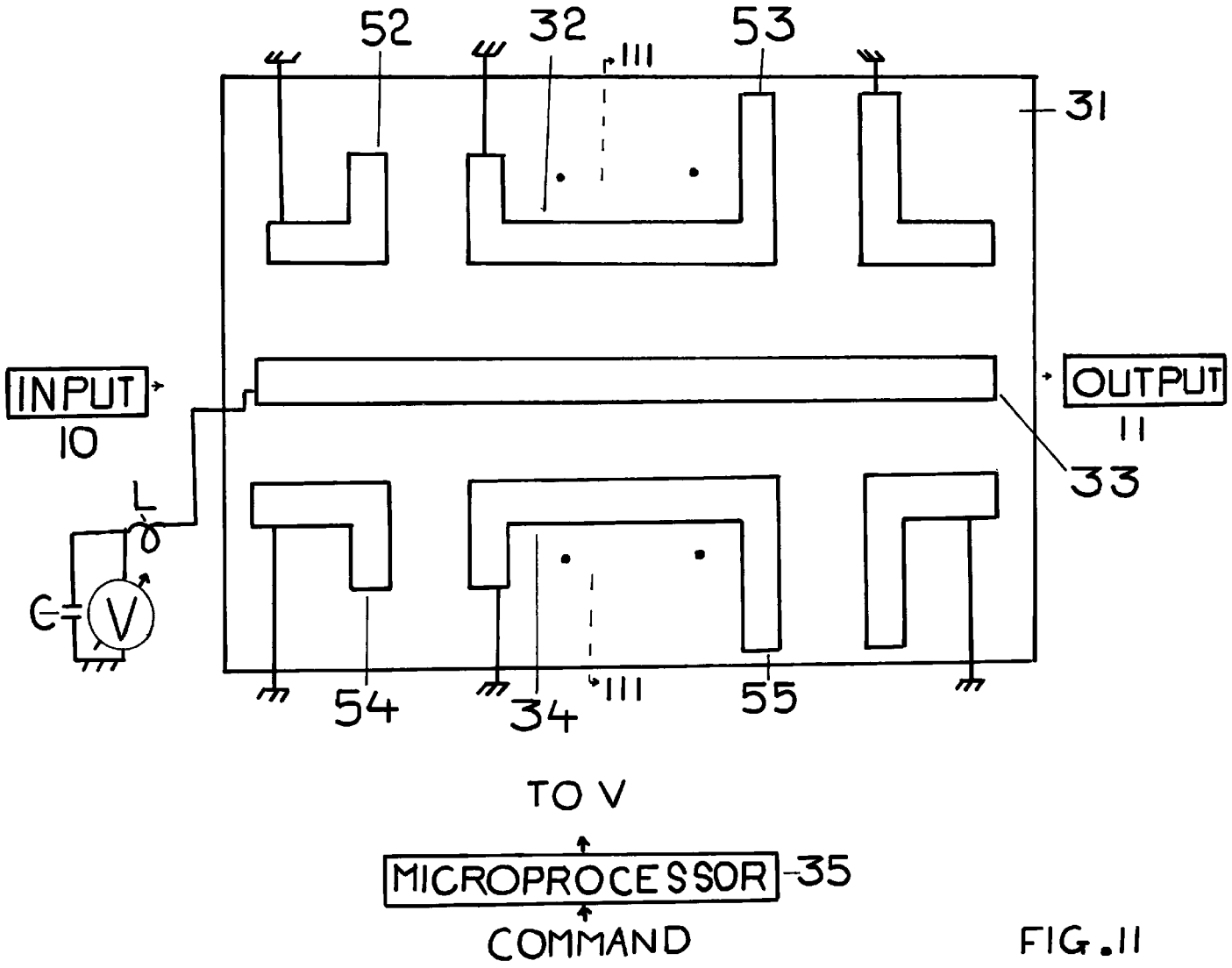
FIG. 11 depicts a top view of another CPW ferroelectric tunable band pass filter.

FIG. 3 also depicts a transverse cross-section of FIG. 10 through section line III—III. FIG. 11 is another embodiment of this invention, a top view of a symmetrical CPW tunable band pass filter. To the CPW second line, designated 32, is attached a quarter wavelength, at an operating frequency of the filter, long branch line 52 open circuited at the other end. To the CPW third line is attached a quarter wavelength, at an operating frequency of the filter, long branch line 54 open circuited at the other end. At an operating frequency of the filter at which the open ended branch lines 52 and 54 are each a quarter wavelength long, each of them impinge a short circuit on the CPW second and third line respectively and the signal flow through the CPW line is unimpeded and there is no attenuation of the input signal. As the operating frequency of the filter changes and each of the branch lines 52 and 54 is no longer a quarter wavelength long, a finite impedance is impinged on the CPW second and third lines, designated by 32 and 34, respectively and the input signal is impeded as it flows through to the output introducing an attenuation. As the operating frequency of the filter changes where the branch CPW lines 52 and 54 are further away from a quarter wavelength long, a larger impedance is impinged on the CPW second and third lines, represented by 32 and 34, respectively greatly impeding the flow of the input signal as It travels towards the output and introducing a greater amount of attenuation. Thus a band pass filter is obtained. Upon the application of a bias voltage V to the filter, the permittivity of the single crystal ferroelectric material 31, between the CPW lines, changes thus changing the electrical length of the branch CPW lines 52 and 54 and the frequency of maximum response of the filter. Upon the application of different levels of bias voltages V to the filter, different values of permittivity are obtained for the single crystal ferroelectric material 31. As a result, different values of electrical lengths are obtained for the branch CPW lines 52 and 54. Consequently, different frequencies of maximum output for the band pass filter are obtained. Thus a tunable band pass filter is obtained. To the CPW second line, designated 32, is attached another branch CPW line 53 which is a quarter wavelength long at an operating frequency of the filter. To the CPW third line, designated 34, is attached another branch CPW line 55 which is a quarter wavelength long at an operating frequency of the filter. The operation of branch CPW lines 53 and 55 are identical to those of branch CPW lines 52 and 54 respectively. Only two branch CPW lines are shown in FIG. 11. In practice there are 1, 2 . . . n branch quarter wavelength sections in a tunable band pass filter depending on the requirements. When the branch CPW sections are quarter wavelength long at the same frequency then a larger attenuation, compared to that obtained with a single branch CPW section, is obtained outside the pass band. When the adjacent branch CPW sections are quarter wavelength long at respectively a staggered frequency, then a broad bandwidth tunable band pass filter is obtained. By reference, the rest of the discussions of FIG. 9 are included here. Same number/label refers to the same element throughout this document. FIG. 11 has input 10 and output 11.

FIG. 3 also depicts a transverse cross-section of FIG. 11 through section line III—III.

Figure 12:
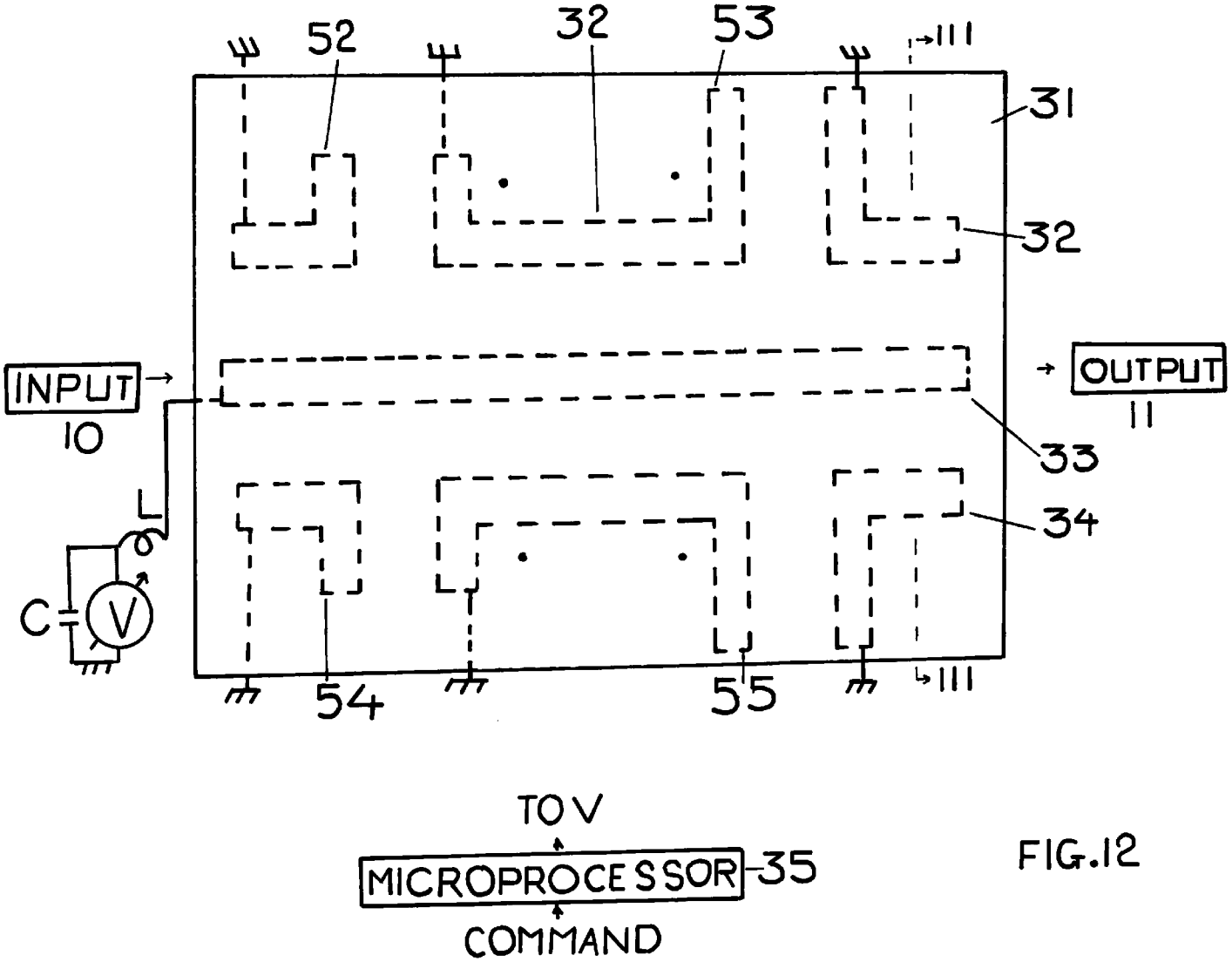
FIG. 12 depicts a top view of another CPW ferroelectric tunable band pass filter.

FIG. 12 depicts another embodiment of this invention, a top view of tunable band pass filter. The basic difference between FIG. 12 and FIG. 11 is in a second layer and a third layer. In FIG. 12, the second layer is the conductive film depositions of the tunable filter on top of a single crystal dielectric substrate 41. The third layer is a film 31 of a single crystal ferroelectric material deposited on a second layer, conductive depositions of the filter, and a first layer a single crystal dielectric substrate 41. Same number/label refers to the same element throughout this document. The rest of the discussions of FIG. 9 is repeated here by reference. Input is 10 and output is 11.

FIG. 6 also depicts a transverse cross-section of FIG. 12 through section line III—III.

Figure 13:
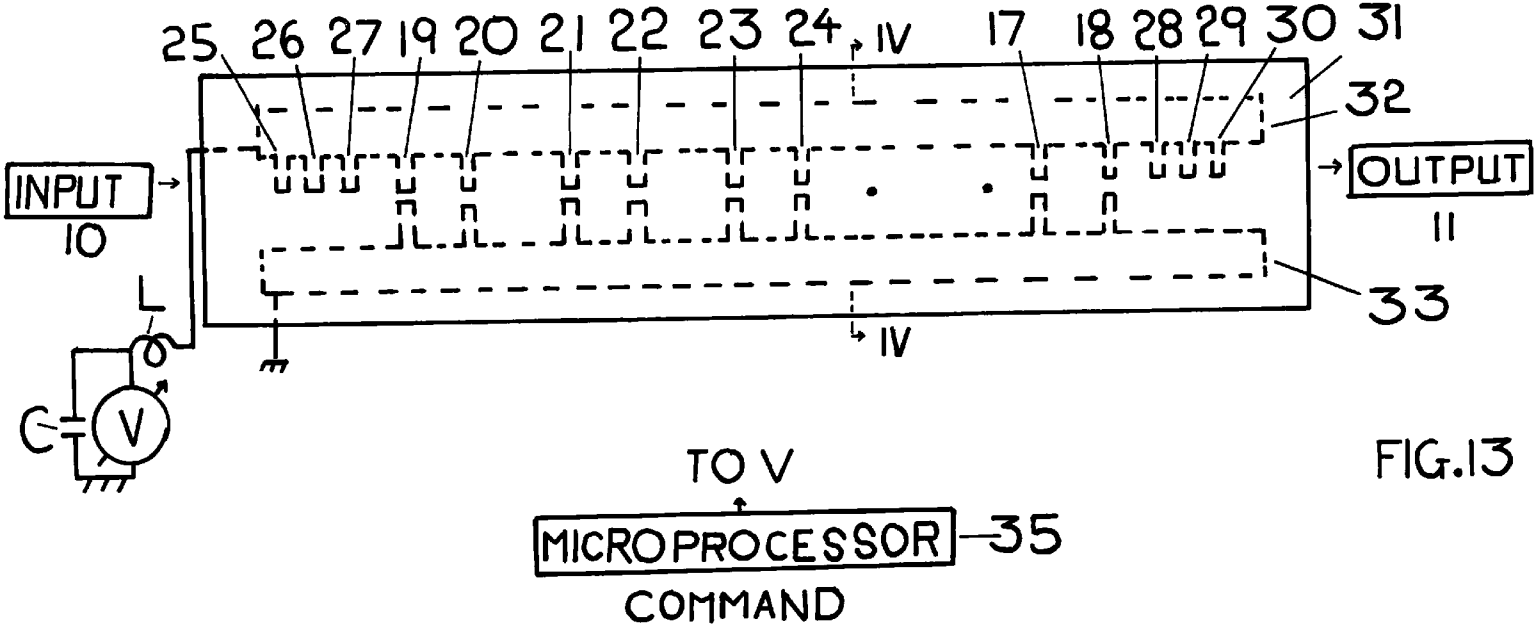
FIG. 13 depicts a top view of another CPW ferroelectric tunable band pass filter.

FIG. 13 depicts another embodiment of this invention, an asymmetrical CPW tunable filter. A fourth layer is removed and not shown in FIG. 13. A third layer is a film of a single crystal ferroelectric material 31. A second layer, shown dotted, is the circuit of the tunable filter underneath the film of a single crystal ferroelectric material 31. The asymmetrical CPW sections are 32 and 33 formed of a film of a conductive material deposited on a first layer, not shown in FIG. 13, which is a substrate of a single crystal dielectric material. Between 32 and 33 are pairs of irises 19 and 20, 21 and 22, 23 and 24, and 17 and 18. If needed, for matching the impedance of an input circuit of the filter to the input impedance of the filter, input matching stubs 25, 26, 27 are provided. If needed, for matching the impedance of an output circuit of the filter to the output impedance of the filter, output matching stubs 28, 29, 30 are provided. By reference, the applicable discussions of FIG. 1 are repeated here. Same number/label refers to the same element throughout this document.

Figure 14:
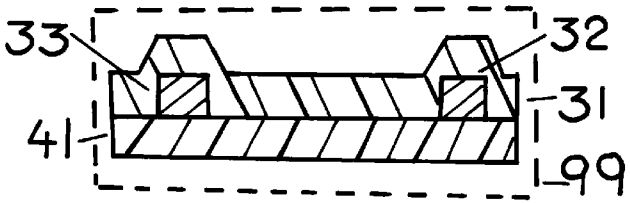
FIG. 14 depicts a transverse cross-section of FIG. 13 through section line IV—IV.

FIG. 14 depicts a transverse cross-section of FIG. 13 through section line MN. A first layer is a substrate of a single crystal dielectric material 41. The asymmetrical CPW sections 32 and 33 are part of a second layer . Sections 32 and 33 are formed by the deposition of films of a conductive material. A third layer is a film of a single crystal ferroelectric material. The applicable discussions of FIG. 6 are repeated here. This configuration minimizes/eliminates any unwanted radiation.

Figure 15:
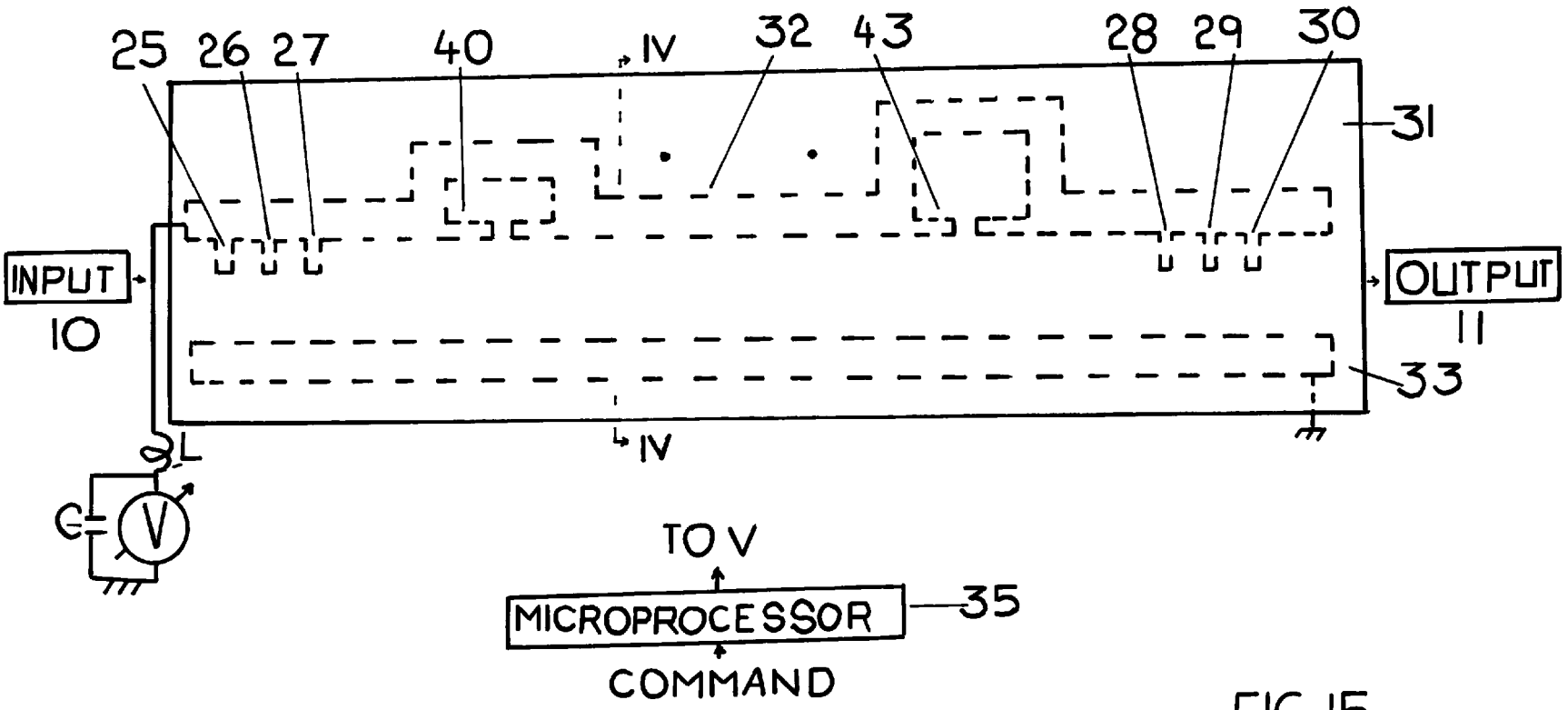
FIG. 15 depicts another embodiment of this invention an asymmetrical CPW ferroelectric tunable band reject filter.

FIG. 15 depicts another embodiment of this invention, an asymmetrical CPW tunable band reject filter. A second layer, shown dotted, is the circuit of the tunable band reject filter. Films, 32 and 33, of a conductive material deposited on a substrate not shown in this diagram form main lines of the asymmetrical CPW. On the main CPW line 32 is inserted a first branch cavity with an iris 40. The length of the first branch cavity is a quarter of a wavelength, at an operating frequency of the filter, long foreshortened by the presence of the iris. A second cavity, with an iris 43, is also introduced on the main line 32. The length of the second cavity is a quarter of a wavelength, at an operating frequency of the filter, long foreshortened by the presence of the iris. Applicable discussions of FIG. 7, by reference, is included here. Same number/label refers to the same element throughout this document.

FIG. 14 also depicts a transverse cross-section of FIG. 15 through section line IV—IV. FIG. 14 has been recited earlier.

Figure 16:
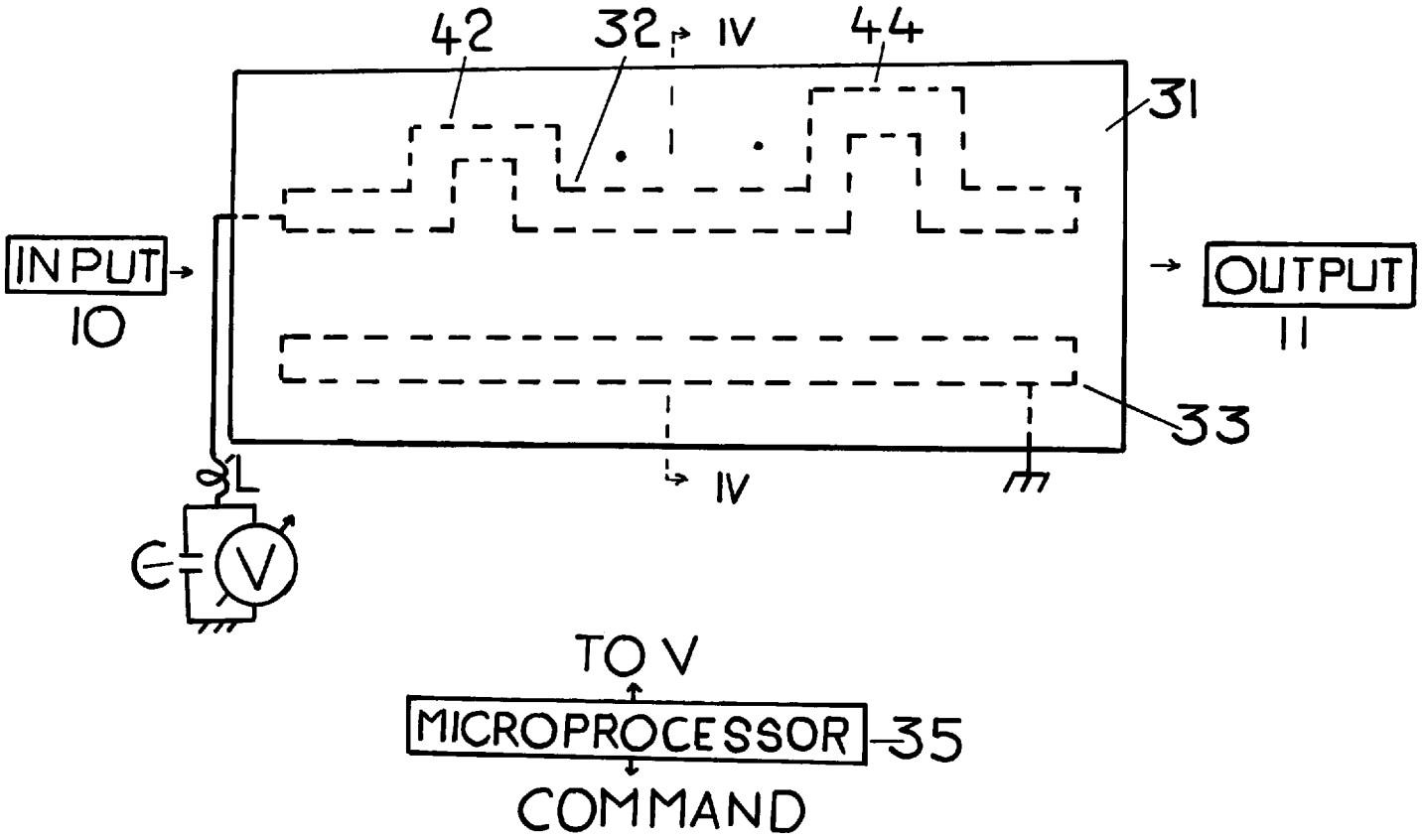
FIG. 16 depicts another embodiment of this invention an asymmetrical CPW ferroelectric tunable band pass filter.

FIG. 16 depicts another embodiment of this invention, an asymmetrical CPW tunable band pass filter. A second layer, shown dotted, is the circuit of the tunable band pass filter. Films, 32 and 33, of a conductive material deposited on a substrate not shown in this diagram form main lines of the asymmetrical CPW. On the main CPW line 32 is inserted a branch line, shorted at the other end, half a wavelength, at an operating frequency of the filter, long line 42. Also is inserted another branch line, shorted at the other end, half a wavelength, at an operating frequency of the filter, long line 44. The applicable portion of the discussions of FIG. 9 is included here by reference. Same number/label refers to the same element throughout this document. Input is 10 and output is 11.

FIG. 14 also depicts a transverse cross-section of FIG. 16 through section line IV—IV. FIG. 14 has been recited earlier.

Figure 17:
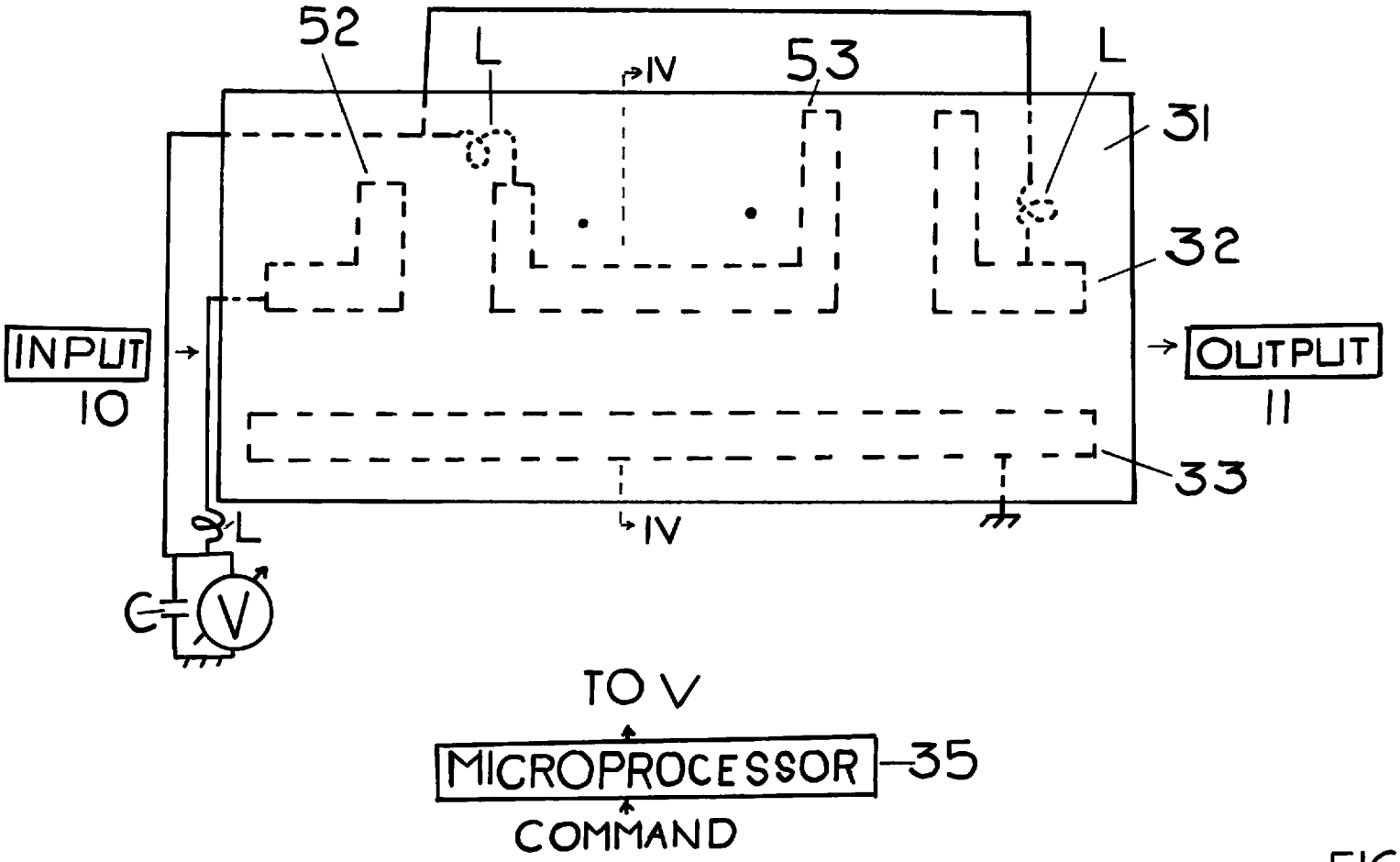
FIG. 17 depicts another embodiment of this invention an asymmetrical CPW ferroelectric tunable band pass filter.

FIG. 17 depicts another embodiment of this invention, an asymmetrical CPW tunable band pass filter. A second layer, shown dotted, is the circuit of the tunable band pass filter. Films, 32 and 33, of a conductive material deposited on a substrate, not shown in this diagram, form main lines of the asymmetrical CPW. On the main CPW line 32 is inserted an open circuited quarter wavelength, at an operating frequency of the tunable filter, long branch line 52. Also on the main CPW line 32 is inserted an open circuited quarter wavelength, at an operating frequency of the tunable filter, long branch line 53. Applicable discussions of FIG. 12 is included here by reference. Same number/label refers to the same element throughout this document. Input is 10 and output is 11. FIG. 14 also depicts a transverse cross-section of FIG. 17 through section line IV—IV. FIG. 14 has been recited earlier.

Figure 18:
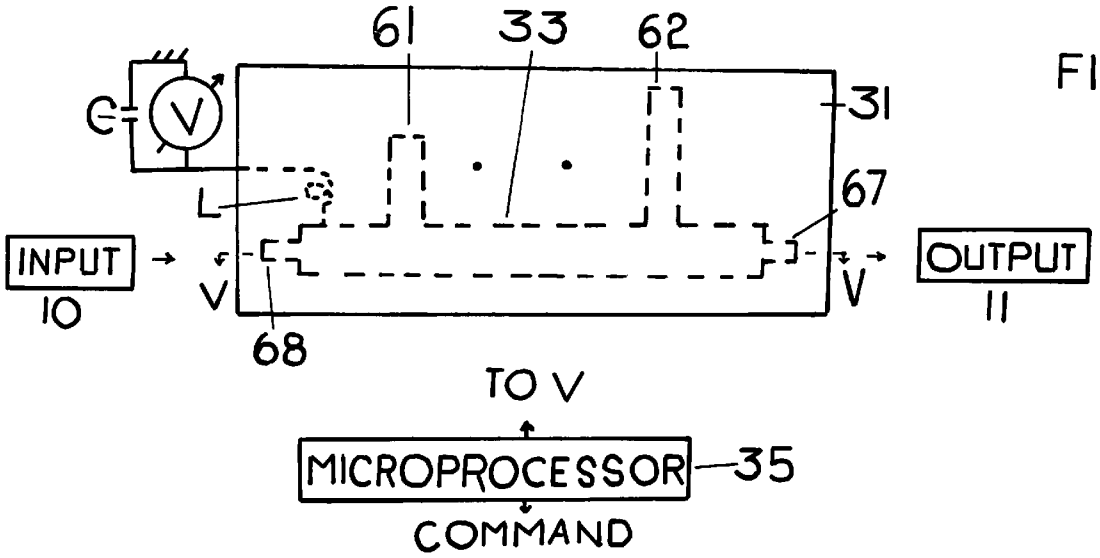
FIG. 18 depicts a top view of another embodiment of this invention a microstrip ferroelectric tunable band pass filter.

FIG. 18 depicts another embodiment of this invention, a microstrip tunable band pass filter. The top fourth layer is not shown and is removed. A third layer is a film of a single crystal ferroelectric material 31. A second layer, shown dotted, is the circuit of the tunable filter. A main microstrip line 33 is formed by depositing a film of a conductive material on a substrate of a single crystal dielectric material not shown in this diagram. An open circuited quarter wavelength, at an operating frequency of the filter, long branch line is 61. For matching an impedance of an input circuit of the filter to an input impedance of the filter, a quarter wavelength, at an operating frequency of the filter, long matching transformer 68 is used. For matching an impedance of an output circuit of the filter to an output impedance of the filter, a quarter wavelength, at an operating frequency of the filter, long matching transformer 67 is used. An open circuited quarter wavelength long branch line impinges a short circuit at the junction of the main microstrip line 33 and the branch line 61, thus producing no impediment to the travel of the input signal to the output. At a frequency at which the branch open circuited line differs from a quarter wavelength long, then a finite impedance is introduced at the junction of the main line 33 and the branch line 61, thus impeding the flow of input signal to the output and introducing an attenuation. At a frequency at which the open circuited branch line is further away from a quarter wavelength long, a higher impedance is introduced at the junction of the main microstrip line 33 and the branch line 61, thus further impeding the flow of input signal to the output and thus introducing a higher amount of attenuation. Thus a band pass filter is obtained. On the application of a bias voltage V through an RF filter containing an inductance L and a capacitance C, the frequency at which the open circuited branch line is a quarter wavelength long changes, thus changing the frequency of maximum output or the lowest attenuation. By the application of different levels of bias voltages V, the open circuited branch line 61 becomes a quarter wavelength respectively at different frequencies, thus a tunable band pass filter is obtained. Input is 10 and the output is 11. The frequencies of lowest attenuation or frequencies of maximum output versus different levels of bias voltages V are stored in a memory of a microprocessor 35. Another open circuited quarter wavelength, at an operating frequency of the filter, long branch line is 62 and it performs in a manner similar to the branch circuit 61. Only two open circuited branch quarter wavelength long lines 61 and 62 are shown in the FIG. 18. In practice, there are 1, 2 . . . n open circuited branch quarter wavelength long lines are present in a filter depending on the requirements. When the open circuited branch lines are quarter wavelength long at the same frequency then an attenuation, higher than that can be obtained with a single open circuited branch line, is obtained. When the open circuited branch lines are quarter wavelength long at frequencies staggered from each other, then a broader bandwidth band pass filter is obtained.

Figure 19:
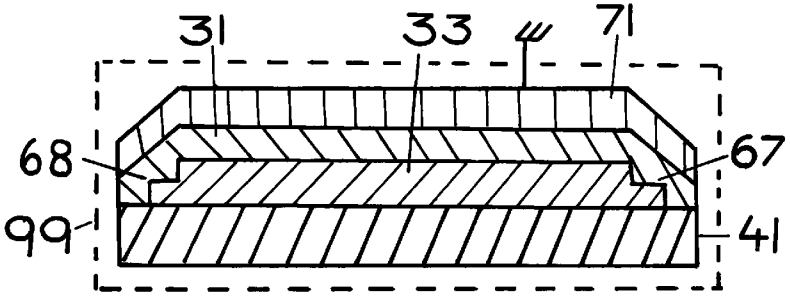
FIG. 19 depicts a longitudinal cross-section of FIG. 18 through section line V—V.

FIG. 19 is a longitudinal cross-section of FIG. 18 through section line V—V. A first layer is a single crystal dielectric material substrate 41. A second layer contains films of a conductive material for the tunable filter circuit. The main microstrip line is 33. The input quarter wavelength long matching transformer is 68 and the output quarter wavelength long matching transformer is 67. A film of a single crystal ferroelectric material 31 of a third layer is deposited on top of the substrate single crystal dielectric material 41 and the conductive depositions of the tunable filter circuit. The heights of the single crystal ferroelectric film for the input 68 and the output 67 transformers are different from the height of the single crystal ferroelectric film for the main microstrip line 33. In a fourth layer, a film 71 of a conductive material is deposited on top of the film 31 of a single crystal ferroelectric material and is connected to an electrical ground. Means for keeping the tunable filter at a constant temperature is element 99. Applicable portions of citations of FIG. 3 are included here by reference. The tunable filter is operated at a temperature slightly above the Curie temperature of the single crystal ferroelectric material.

In all embodiments of this invention herein, a conductive material is copper, gold, silver and is referred to herein as the room temperature conductor. In another embodiment, the conductive material is a single crystal high Tc superconductor.

It should be understood that the foregoing discussions relate to only typical embodiments of the invention and that numerous modifications or alternatives may be made therein, by those of ordinary skill, without departing from the spirit and scope of the invention as set forth in the appended claims. Different frequencies, types of coplanar waveguides, all ferroelectric materials, compositions of ferroelectric materials with powder polythene and other low permittivity materials, ferroelectric liquid crystals (FLC), cavities, irises, stubs and high Tc superconductors are contemplated in this invention.

What is claimed is:

1. A tunable band pass filter having a single crystal ferroelectric material having an electric field dependent permittivity, a single crystal dielectric material, a symmetrical coplanar waveguide (CPW) structure, cavities, irises, stubs, dominant resonant frequency, resonant frequency, operating frequency, input, output and comprising:

a first layer of a single crystal dielectric material substrate;

a single crystalline form of said single crystal dielectric material provides the lowest dielectric losss;

a second layer of a film of said single crystal ferroelectric material deposited on said single crystal dielectric material of said first layer;

a single crystalline form of said single crystal ferroelectric material provides a typical dielectric loss of 0.035 dB per wavelength in the ferroelectric material;

a first line of a symmetrical CPW structure of a third layer being comprised, on said second layer, of a film of a conductive material;

a second line of a symmetrical CPW structure of said third layer, on one side of said first line, being comprised on said second layer, of a film of a conductive material;

a third line of a symmetrical CPW structure of said third layer, on the other side of said first line and being comprised on second layer, of a film of a conductive material;

said first line, second line and third line form a symmetrical CPW structure;

one through n pairs of irises on said third layer being comprised of films of a conductive material;

said first pair of irises of said third layer being inserted between said CPW first line and CPW second line forming a first cavity;

a separation distance between said first pair of irises being a quarter wavelength, at an operating frequency of the filter, long foreshortened by the presence of the irises;

said second pair of irises of said third layer being inserted between said CPW first line and CPW second line forming a second cavity;

a separation distance between said second pair of irises being a quarter wavelength, at an operating frequency of the filter, long foreshortened by the presence of the irises;

a separation distance of three quarters of a wavelength, at an operating frequency of the tunable filter, long being provided between the centers of said first adjacent cavities;

said third, fourth . . . nth pair of irises of said third layer being inserted between said CPW first line and CPW second line forming third through nth cavities respectively;

a separation distance between said third, fourth . . . nth pair of irises being a quarter wavelength, at an operating frequency of the filter, long foreshortened by the presence of the irises;

a separation distance of three quarters of a wavelength, at an operating frequency of the tunable filter, being provided between the centers of said adjacent cavities;

said a second set of first through nth pair of irises, identical to pairs connected between said CPW first line and CPW second line, of said third layer being comprised of films of a conductive material on said second layer and being inserted symmetrically between said CPW first line and CPW third line and respectively forming a second set of symmetrical first through nth cavities;

first transmission means for matching the impedance of an input circuit of said tunable filter to an input impedance of said filter;

second transmission means for matching the impedance of an output circuit of said tunable filter to an output impedance of said filter;

first set of first, through sixth stubs;

said first set of first, second, third stubs of said third layer, being comprised of films of a conductive material, being connected to said CPW second line at the input end of said first pair of irises for matching the impedance of the input circuit of said tunable filter to the input impedance of said tunable filter;

said first set of fourth, fifth, sixth stubs of said third layer, being comprised of films of a conductive material, being connected to said CPW second line at the output end of said nth pair of irises for matching the impedance of the output circuit of said tunable filter to the output impedance of said tunable filter;

second set of first, through sixth stubs;

said second set of first, second, third stubs of said third layer, being comprised of films of a conductive material, being connected to said CPW third line at the input end of said first pair of irises for matching the impedance of the input circuit of said tunable filter to the input impedance of said tunable filter;

said second set of fourth, fifth, sixth stubs of said third layer, being comprised of films of a conductive material, being connected to said CPW third line at the output end of said nth pair of irises for matching the impedance of the output circuit of said tunable filter to the output impedance of said tunable filter;

means, connected to the filter, for application of a variable bias voltage to said filter under the control of a microprocessor to provide maximum output at a specified frequency;

all said irises, stubs, cpw lines being connected together to form said filter;

said conductive material being a single crystal high Tc superconductor;

said tunable filter having a capability to handle a power level of 0.5 MW;

a single crystalline form of said single crystal high Tc superconductor provides a minimum conductive loss; and said tunable filter being operated at a high superconducting temperature slightly above the Curie temperature of said ferroelectric material to avoid hysteresis.

2. A tunable band pass filter of claim 1;

wherein the single crystal ferroelectric material is $Sr_{1-x}Ba_xTiO_3$ and the value of x is between 0.005 and 0.7.

3. A tunable band pass filter of claim 1;

wherein the single crystal high Tc superconductor is TBCCO.

4. A tunable band pass filter of claim 1;

wherein all the cavities are tuned to the same dominant resonant frequency.

5. A tunable band pass filter of claim 1;

wherein the single crystal high Tc superconductor is YBCD.

6. A tunable band pass filter of claim 5;

wherein the single crystal ferroelectric material is $Sr_{1-x}Ba_xTiO_3$ and the value of x is between 0.005 and 0.7.

7. A tunable band reject filter having a single crystal ferroelectric material having an electric field dependent permittivity, a single crystal dielectric material, a symmetrical coplanar waveguide (CPW) structure, cavities, irises, stubs, dominant resonant frequency, operating frequency, input, output and comprising:

a first layer of a single crystal dielectric material substrate;

a single crystalline form of said single crystal dielectric material provides the lowest dielectric loss;

a first line of a symmetrical CPW structure of a third layer being comprised, on said second layer, of a film of a conductive material;

a second line of a symmetrical CPW structure of said third layer, on one side of said first line, being comprised, on said second layer, of a film of a conductive material;

a third line of a symmetrical CPW structure of said third layer, on the other side of said first line, being comprised, on said second layer, of a film of a conductive material;

said first line, second line and third line form a symmetrical CPW structure;

n being an even number;

first through n irises;

first through nth branch CPW lines;

first through nth cavities;

a first branch CPW line, the ends thereof being short circuited, being connected to said second CPW structure through a first iris and forming a first cavity;

a second branch CPW line, the ends thereof being short circuited, being connected to said third CPW structure through a second iris and forming a second cavity;

said first and second cavities being tuned to a first dominant resonant frequency;

a third branch CPW line, the ends thereof being short circuited, being connected to said second CPW structure through a third iris and forming a third cavity;

a fourth branch CPW line, the ends thereof being short circuited, being connected to said third CPW structure through a fourth iris and forming a fourth cavity;

said third and fourth cavities being tuned to a second dominant resonant frequency;

one through pth, p being an even number, input stubs;

for matching the impedance of an input circuit of said tunable filter to an impedance of said tunable filter, said first, second through p/2th input stubs being connected respectively to said second CPW structure at locations between said input of said filter and said first iris;

for matching the impedance of the input circuit of said tunable filter to an impedance of said tunable filter, said (p/2+1)th, (p/2+2)th through pth input stubs being connected respectively to said third CPW structure at locations between said input of said filter and said second iris;

fifth, seventh through (n−1)th odd numbered branch CPW lines, ends thereof being short circuited, being connected to said second CPW structure through fifth, seventh through (n−1)th irises respectively and forming fifth, seventh through (n−1)th odd numbered cavities;

fifth, seventh through (n−1)th cavities being tuned to fifth, seventh through (n−1)th dominant resonant frequencies;

sixth, eighth through nth even numbered branch CPW lines, ends thereof being short circuited, being connected to said third CPW structure through sixth, eighth through nth irises respectively and forming sixth, eighth through nth even numbered cavities;

sixth, eighth through nth cavities being tuned to fifth, seventh through nth dominant resonant frequencies respectively;

a separation distance between centers of said adjacent cavities being three quarters of a wavelength, at an operating frequency of the filter, long;

the odd numbered cavities being located symmetrically opposite to the even numbered cavities respectively;

one through pth, p being an even number, output stubs;

for matching the impedance of an output circuit of said tunable filter to an impedance of said tunable filter, said first, second through p/2th output stubs being connected respectively to said second CPW structure at locations between said output of said filter and said (n−1)th iris;

for matching the impedance of the output circuit of said tunable filter to an impedance of said tunable filter, said (p/2+1)th, (p/2+2)th through pth output stubs being connected respectively to said third CPW structure at locations between said output of said filter and said nth iris;

said first through nth branch CPW lines, said first through nth irises, said first through pth input and output stubs comprised of films of a conductor deposited on said film of a single crystal ferroelectric material of second layer;

means, connected to said filter, for application of a variable bias voltage to said filter under the control of a microprocessor to provide maximum output at a specified operating frequency;

said tunable filter having a capability to operate at a power level of 0.5 MW;

said first, second and third CPW structures, said branch CPW lines,said irises, said stubs all connected together to produce at tunable band reject filter;

said conductive material being a single crystal high Tc superconductor;

a single crystalline form of said single crystal high Tc superconductor provides a minimum conductive loss; and said tunable filter being operated at a high superconducting temperature slightly above the Curie temperature to avoid hysteresis.

8. A tunable band pass filter of claim 7;

wherein the single crystal high Tc superconductor is TBCCO.

9. A tunable band pass filter of claim 8; wherein the single crystal ferroelectric material is strontium barium titanate.

10. A tunable band pass filter of claim 7;

wherein the single crystal high Tc superconductor is YBCO.

11. A tunable band pass filter of claim 10;

wherein the single crystal ferroelectric material is $Sr_{1-x}Ba_xTiO_3$ and the value of x is between 0.005 and 0.7.

12. A tunable band pass filter having a single crystal ferroelectric material having an electric field dependent permittivity, a single crystal dielectric material, a symmetrical coplanar waveguide (CPW) structure, cavities, stubs, dominant resonant frequency, operating frequency, input, output and comprising:

a first layer of a single crystal dielectric material substrate;

a single crystalline form of said single crystal dielectric material provides the lowest dielectric loss;

a first line of a symmetrical CPW structure of a second layer being comprised, on said first layer, of a film of a conductive material;

a second line of a symmetrical CPW structure of said second layer, on one side of said first line, being comprised, on said first layer, of a film of a conductive material;

a third line of a symmetrical CPW structure of said second layer, on the other side of said first line, being comprised, on said first layer of a film of a conductive material;

said first line, second line, and third line form a symmetrical CPW structure, n being an even number;

first through nth branch CPW lines;

a first branch CPW line one half a wavelength, at an operating frequency of said tunable filter, long, the ends thereof being short circuited, being connected to said second CPW structure;

a second branch CPW line one half a wavelength, at an operating frequency of said tunable filter, long, the ends thereof being short circuited, being connected to said third CPW structure;

said first and second branch half a wavelength long CPW lines being half a wavelength long at a first operating frequency of said tunable filter;

a third branch CPW line one half a wavelength, at an operating frequency of said tunable filter, long, the ends thereof being short circuited, being connected to said second CPW structure;

a fourth branch CPW line one half a wavelength, at an operating frequency of said tunable filter, long, the ends thereof being short circuited, being connected to said third CPW structure;

said third and fourth branch half a wavelength long CPW lines being half a wavelength long at a second operating frequency of said tunable filter;

one through pth, p being an even number, input stubs;

for matching the impedance of an input circuit of said tunable filter to an impedance of said tunable filter, said first, second through p/2th input stubs being connected respectively to said second CPW structure at locations between said input of said filter and said first branch CPW line;

for matching the impedance of the input circuit of said tunable filter to an impedance of said tunable filter, said (p/2+1)th, (p/2+2)th through pth input stubs being connected respectively to said third CPW structure at locations between said input of said filter and said second branch CPW line;

fifth, seventh through (n−1)th odd numbered branch CPW lines being half a wavelength long at an operating frequency of said tunable filter, ends of each thereof being short circuited, being connected to said second CPW structure;

fifth, seventh through (n−1)th branch half a wavelength long lines being half a wavelength long respectively at third, fourth through dominant resonant frequencies respectively;

sixth, eighth through nth even numbered branch CPW lines being half a wavelength long at an operating frequency of said tunable filter, ends of thereof being short circuited, being connected to said third CPW structure;

sixth, eighth through nth branch half a wavelength long lines being half a wavelength long respectively at third, fourth through n/2th dominant resonant frequencies respectively;

a separation distance between centers of said adjacent branch half wavelength CPW lines being three quarters of a wavelength, at an operating frequency of the filter, long;

the odd numbered branch half a wavelength CPW lines being located symmetrically opposite to the even numbered branch half wavelength long CPW lines respectively;

one through pth, p being an even number, output stubs;

for matching the impedance of an output circuit of said tunable filter to an impedance of said tunable filter, said first, second through p/2th output stubs being connected respectively to said second CPW structure at locations between said output of said filter and said (n−1)th branch half a wavelength branch CPW line;

for matching the impedance of the output circuit of said tunable filter to an impedance of said tunable filter, said (p/2+1)th, (p/2+2)th through pth output stubs being connected respectively to said third CPW structure at locations between said output of said filter and said nth half a wavelength long branch CPW line;

said first through nth branch CPW lines, said first through pth input and output stubs comprised of films of a conductor deposited on said film of said single crystal dielectric material of said first layer;

a third layer of a film of said single crystal ferroelectric material deposited on said single crystal dielectric material of said first layer and films of conductive material of said second layer;

said single crystalline form of said single crystal ferroelectric material provides a typical dielectric loss of 0.035 dB per wavelength in the ferroelctric material;

means, connected to said filter, for application of a variable bias voltage to said filter under the control of a microprocessor to provide maximum output at a specified operating frequency;

said tunable filter having a capability to operate at a power level of 0.5 MW;

said first, second and third CPW structures, said branch CPW lines, said stubs all connected together to produce a tunable band pass filter;

said conductive material being a single crystal high Tc superconductor;

a single crystalline form of said single crystal high Tc superconductor provides a minimum conductive loss; and said tunable filter being operated at a high superconducting temperature slightly above the Curie temperature to avoid hysteresis.

13. A tunable filter of claim 12: wherein the single crystal high Tc superconductor is TBCCO.

14. A tunable filter of claim 12: wherein the single crystal high Tc superconductor is TBCCO and the single crystal ferroelectric material is $Sr_{1-x}Ba_xTiO_3$and the value of x is between 0.005 and 0.7.

15. A tunable band pass filter of claim 12;

wherein the single crystal high Tc superconductor is YBCO.

16. A tunable band pass filter of claim 15;

wherein the single crystal ferroelectric material is $Sr_{1-x}Ba_xTiO_3$ and the value of x is between 0.005 and 0.7.

17. A tunable band pass filter having a single crystal ferroelectric material having an electric field dependent permittivity, a single crystal dielectric material, a symmetrical coplanar waveguide (CPW) structure, cavities, stubs, dominant resonant frequency, operating frequency, input, output and comprising:

a first layer of a single crystal dielectric material substrate;

a single crystalline form of said single crystal dielectric material provides the lowest dielectric loss;

a second layer of a film of said single crystal ferroelectric material deposited on said single crystal dielectric material of said first layer;

a single crystalline form of said single crystal ferroelectric material provides a typical dielectric loss of 0.035 dB per wavelength in the ferroelectric material;

a first line of a symmetrical CPW structure of a third layer being comprised, on said second layer, of a film of a conductive material;

a second line of a symmetrical CPW structure of said third layer, on one side of said first line, being comprised, on said second layer, of a film of a conductive material;

a third line of a symmetrical CPW structure of said third layer, on the other side of said first line, being comprised, on said second layer of a film of a conductive material;

said first line, second line and third line form a symmetrical CPW structure;

n being an even number;

first through nth branch CPW lines;

a first branch CPW line one half a wavelength, at an operating frequency of said tunable filter, long the ends thereof being short circuited, being connected to said second CPW structure;

a second branch CPW line one half a wavelength, at an operating frequency of said tunable filter, long, the ends thereof being short circuited, being connected to said third CPW structure;

said first and second branch half a wavelength long CPW lines being half a wavelength long at a first operating frequency of said tunable filter;

a third branch CPW line one half a wavelength, at an operating frequency of said tunable filter, long, the ends thereof being short circuited, being connected to said second CPW structure;

a fourth branch CPW line one half a wavelength, at an operating frequency of said tunable filter, long, the ends thereof being short circuited, being connected to said third CPW structure;

said third and fourth branch half a wavelength long CPW lines being half a wavelength long at a second operating frequency of said tunable filter;

one through pth, p being an even number, input stubs;

for matching the impedance of an input circuit of said tunable filter to an impedance of said tunable filter, said first, second through p/2th input stubs being connected respectively to said second CPW structure at locations between said input of said filter and said first branch CPW line;

for matching the impedance of the input circuit of said tunable filter to an impedance of said tunable filter, said (p/2+1)th, (p/2+2)th through pth input stubs being connected respectively to said third CPW structure at locations between said input of said filter and said second branch CPW line;

fifth, seventh through (n−1)th odd numbered branch CPW lines being half a wavelength long at an operating frequency of said tunable filter, ends thereof being short circuited, being connected to said second CPW structure;

fifth, seventh through (n−1)th branch half a wavelength long lines being half a wavelength long respectively at third, fourth through dominant resonant frequencies respectively;

sixth, eighth through nth even numbered branch CPW lines being half a wavelength long at an operating frequency of said tunable filter, ends thereof being short circuited, being connected to said third CPW structure;

sixth, eighth through nth branch half a wavelength long lines being half a wavelength long respectively at third, fourth through n/2th dominant resonant frequencies respectively;

a separation distance between centers of said adjacent branch half a wavelength CPW lines being three quarters of a wavelength, at an operating frequency of the filter, long;

the odd numbered branch half a wavelength CPW lines being located symmetrically opposite to the even numbered branch half a wavelength long CPW lines respectively;

one through pth, p being an even number, output stubs;

for matching the impedance of an output circuit of said tunable filter to an impedance of said tunable filter, said first, second through p/2th output stubs being connected respectively to said second CPW structure at locations between said output of said filter and said (n−1)th branch half a wavelength branch CPW line;

for matching the impedance of the output circuit of said tunable filter to an impedance of said tunable filter, said (p/2+1)th, (p/2+2)th through pth output stubs being connected respectively to said third CPW structure at locations between said output of said filter and said nth half a wavelength long branch CPW line;

said first through nth branch CPW lines, said first through pth input and output stubs comprised of films of a conductor deposited on said film of said single crystal ferroelectric material of said second layer;

means, connected to said filter, for application of a variable bias voltage to said filter under the control of a microprocessor to provide maximum output at a specified operating frequency;

said tunable filter having a capability to operate at a power level of 0.5 MW;

said first, second and third CPW structures, said branch CPW lines, said stubs all connected together to produce a tunable band pass filter;

said conductive material being a single crystal high Tc superconductor;

a single crystalline form of said single crystal high Tc superconductor provides a minimum conductive loss; and said tunable filter being operated at a high superconducting temperature slightly above the Curie temperature to avoid hysteresis.

18. A tunable filter of claim 17:

wherein the single crystal high Tc superconductor is TBCCO and the single crystal ferroelectric material is $Sr_{1-x}Ba_xTiO_3$ and the value of x is between 0.005 and 0.7.

19. A tunable band pass filter of claim 17;

wherein the single crystal high Tc superconductor is YBCO.

20. A tunable band pass filter of claim 19;

wherein the single crystal ferroelectric material is $Sr_{1-x}Ba_xTiO_3$ and the value of x is between 0.005 and 0.7.

* * * * *